United States Patent [19]

Kryzanowsky

[11] 4,222,303

[45] Sep. 16, 1980

[54] MUSICAL JUSTIFICATION FOR GUITARS AND THE LIKE

[76] Inventor: Dmytro M. Kryzanowsky, 32-85 37th St., Long Island City, N.Y. 11103

[21] Appl. No.: 961,527

[22] Filed: Nov. 21, 1978

[51] Int. Cl.[3] ..... G10D 3/04; G10D 3/08

[52] U.S. Cl. ..... 84/315; 84/318

[58] Field of Search ..... 84/293, 315–318, 84/319

[56] References Cited

U.S. PATENT DOCUMENTS

| | | | |
|---|---|---|---|
| 513,165 | 1/1894 | Whelan et al. | 84/318 |
| 1,094,038 | 4/1914 | Weaver et al. | 84/317 |
| 2,744,433 | 5/1956 | Rooms | 84/315 |
| 3,392,618 | 7/1968 | Pelensky | 84/293 X |
| 3,568,560 | 3/1971 | Chang et al. | 84/317 |
| 3,834,267 | 9/1974 | Shubb et al. | 84/318 |

*Primary Examiner*—Lawrence R. Franklin

*Attorney, Agent, or Firm*—Hubbell, Cohen, Stiefel & Gross

[57] ABSTRACT

A justifying device for a stringed musical instrument comprises a housing having a plurality of keys mounted in the upper part thereof for vertical movement between an initial position and a depressed position, the keys being arranged in the housing in transverse and longitudinal symmetry for simplifying play with each transverse row of keys corresponding to a given fret; a plurality of tongues mounted for vertical movement in the lower part of the housing and arranged in longitudinal asymmetry for alignment with the frets, there being one tongue for each key; means for connecting each key to its corresponding tongue for vertical movement therewith; means for biasing the keys to their initial positions; and presetting means movably mounted on the housing for selectively depressing a transverse row of keys.

3 Claims, 6 Drawing Figures

FIG. 1.
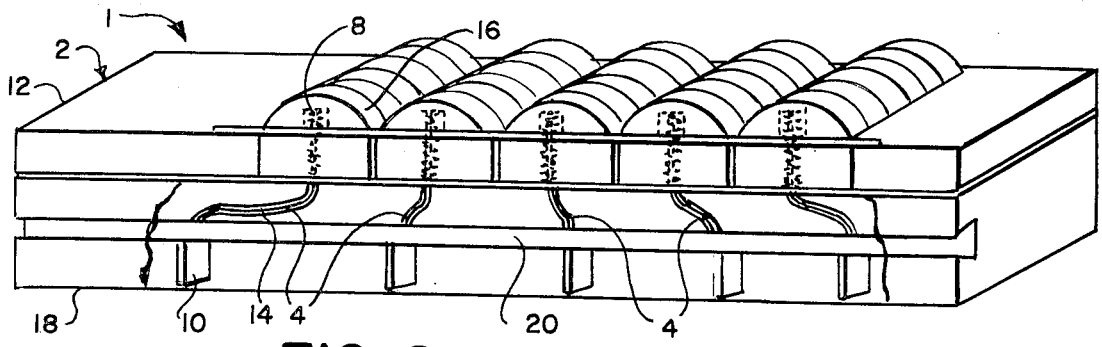
FIG. 2.
FIG. 5.
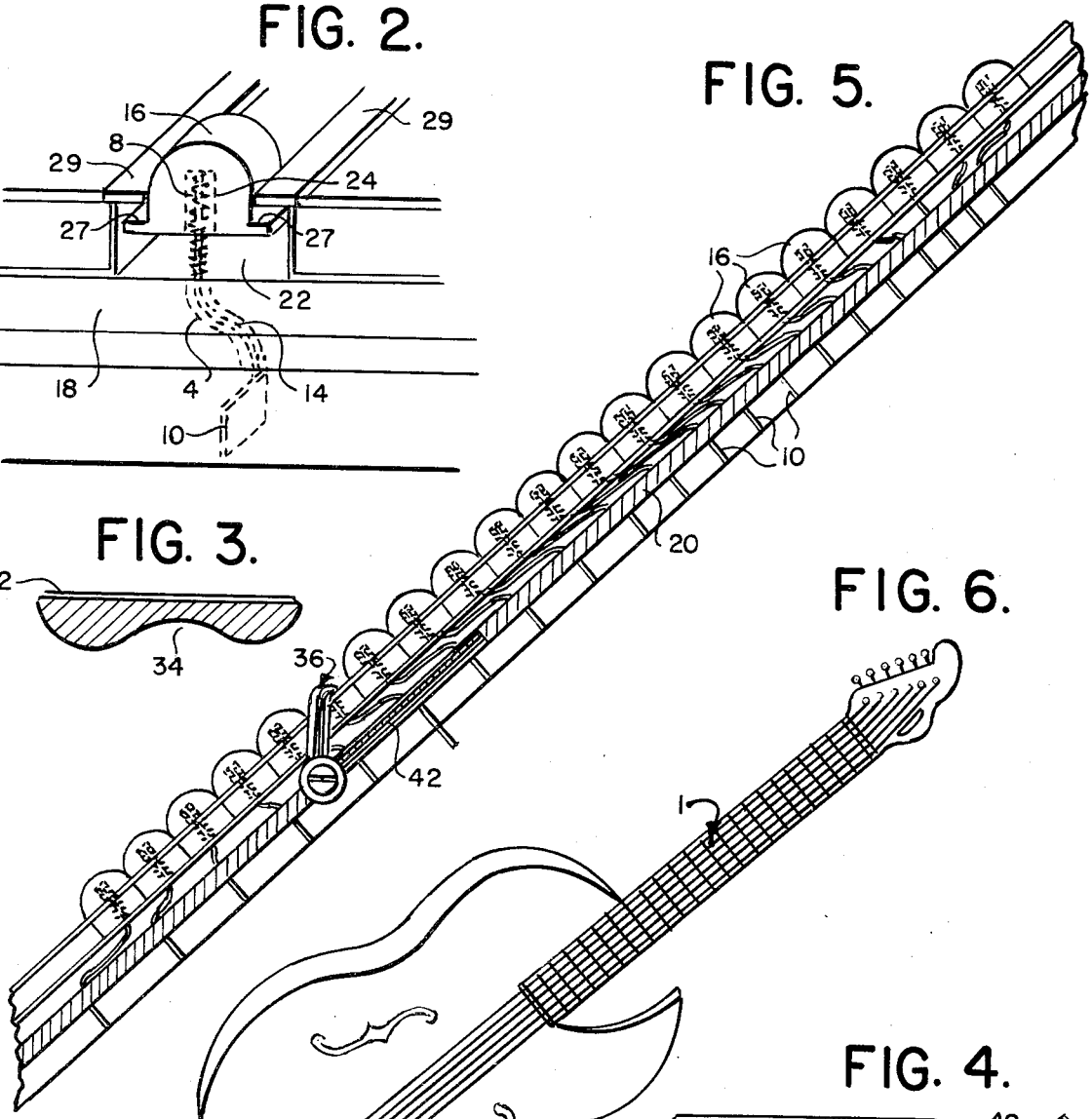
FIG. 3.
FIG. 6.
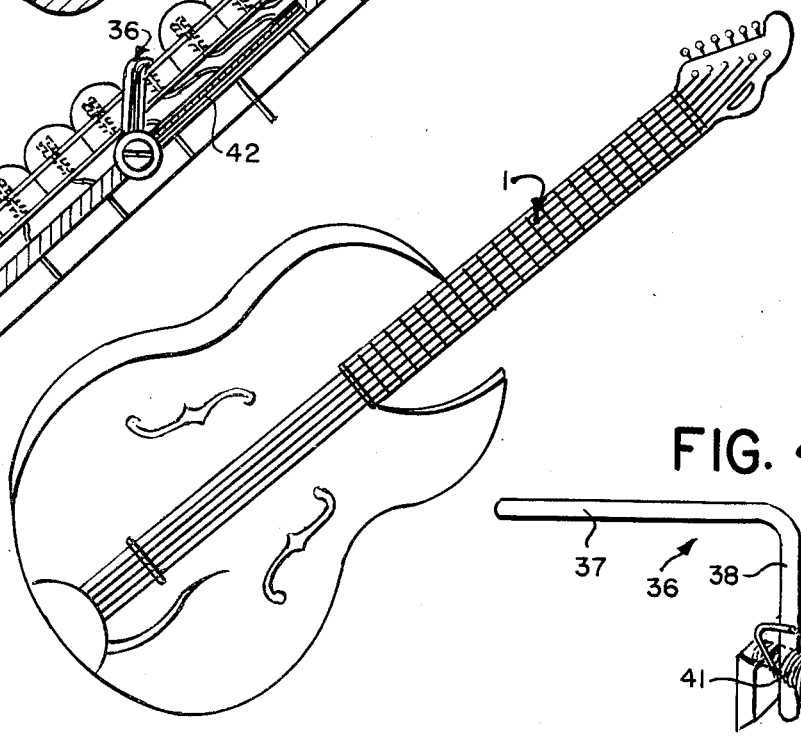
FIG. 4.
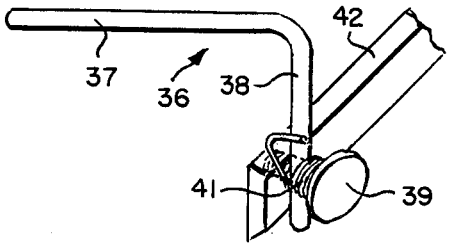

MUSICAL JUSTIFICATION FOR GUITARS AND THE LIKE

BACKGROUND OF THE INVENTION

1. Field of the Invention

This invention relates to a new justified fretted fingerboard to be used on stringed musical instruments such as guitars, mandolins, balalaikas and the like.

2. Statement of the Prior Art

The theoretical background of the present invention relates to a novel musical notation disclosed and published by applicant under the title "Musical Inspiration". While this publication discloses the theoretical simplification of musical notation the present invention provides the mechanical simplification for playing fretted stringed instruments.

Generally, the frets of a musical stringed instrument are arranged in continuously reduced intervals, e.g. the intervals between the frets of a guitar in the area of the highest tones are almost three times smaller than the intervals between the frets in the area of the lowest tones. This irregular arrangement of frets renders the learning and playing of fretted musical instruments difficult. One problem commonly encountered is that while fingering various combinations of tones and chords at one part of the fingerboard the beginning performer finds it difficult to adjust his grip to other fingerboard sections due to the varying distances between the frets. The device of the present invention justifies all intervals between the frets, i.e. provides a symmetrical fingerboard, thus rendering the playing of fretted musical instruments easier and more enjoyable.

SUMMARY OF THE INVENTION

The present invention provides a justified fretted fingerboard for stringed instruments such as guitars, balalaikas and the like. The justifying device is contained in a housing mountable on the conventional fingerboard and includes a plurality of keys mounted in the upper part of the housing for vertical movement therein between an initial position and a depressed position. The keys are arranged in both transverse and longitudinal symmetry, there being a transverse row of keys for each fret, each key in the row corresponding to a particular string in the fret. A plurality of tongues, one for each key, are mounted for vertical movement in the lower part of the housing, and means are provided for connecting the tongues to the keys for vertical movement therewith. The tongues are arranged in longitudinal asymmetry for alignment with the fret positions on the conventional fingerboard. Accordingly, depression of a particular key will move its corresponding tongue against the confronting string on the fingerboard. Biasing means are provided for returning the keys and tongues to their initial positions upon release of the keys. It will therefore be apparent that play only requires depression of the keys, and that play is thereby facilitated thanks to the asymmetrical arrangement of the keys.

The justifying device of the invention further includes presetting means movably mounted on the housing. The presetter includes means, such as an arm, for depressing a transverse row of keys corresponding to a particular fret thereby raising the pitch of all the strings.

Further features and advantages of the present invention will be more fully apparent from the following detailed description and annexed drawings of the preferred embodiment thereof.

BRIEF DESCRIPTION OF THE DRAWINGS

In the drawings:

FIG. 1 is a fragmentary perspective view of a justified keyboard in accordance with the present invention;

FIG. 2 is a fragmentary perspective view of one justifier assembly;

FIG. 3 is a cross-sectional view of the fingerboard of a guitar according to the invention;

FIG. 4 is a perspective view of the presetting device according to the invention;

FIG. 5 is an elevational view of the justified keyboard and presetter according to the invention; and FIG. 6 is a perspective view of a guitar with a justified fingerboard according to the invention.

DETAILED DESCRIPTION OF THE PREFERRED EMBODIMENT

FIG. 1 illustrates the preferred justification device 1 for five different fret positions of a fretted musical instrument having six strings. The justification device 1, or justifier, includes a justifying block 2 having channels 4, and of the justifiers 6, each including a spring 8, tongue 10, cable 14 and key 16.

The push buttons or keys 16 of the justifiers 6 are symmetrically arranged so that they may be fingered with ease and speed while the justifying tongues 10 are arranged asymmetrically, i.e. like a mirror image of the frets of a conventional fingerboard.

As preferred and shown, the justifying block 2 preferably comprises two parts, an upper part 12 for housing the keys 16 and a lower part 18 for housing the tongues 10. One lateral side of the lower part 18 is provided with an elongated tapered groove 20 for slidably mounting a presetting device as is explained in detail below.

As best shown in FIG. 2, each key 16 is preferably provided with a channel 24 extending vertically therethrough and open at the bottom. Received in each channel 24 is the upper end of a spring 8 and the upper end of the corresponding cable 14, the cable and spring being secured together, as by a suitable adhesive. For reasons that will be apparent immediately hereinafter, cables 14 are preferably semi-rigid. Hollow spaces 22 are provided in the upper part 12 of the block 2 beneath each key 16 for accommodating free downward movement of the keys 16. Each key 16 is provided with projections 27 which rest against the surface 29 of the part 12 and serve as a stop to limit upward movement of the keys. The keys 16 are biased to their uppermost positions by the springs 8 which are sufficiently long that their lower ends rest on the upper surface of the lower part 18. The lower end of each cable 14 is secured to its corresponding tongue 10 via channels 4 in the lower part 18 provided for this purpose.

It will thus be apparent that depression of a key 16 results in downward movement of the corresponding spring 8, cable 14 and tongue 10, thus urging the tongue 10 against the confronting string on the conventional fingerboard. For this purpose, tongues 10 have a preferably rectangular shape and are felt tipped to damp the springs after release. It will also be apparent that upon release of the key 16, spring 8 returns key 16, cable 14 and tongue 10 to their initial positions.

FIG. 3 is a cross-sectional view showing a preferred fingerboard for a guitar according to the invention. As shown, the back of fingerboard 32 has an indentation 34 intended to provide a strong and comfortable hold as well as a smooth gliding path for the thumb of the performer during the use of the instrument.

FIG. 4 illustrates a presetting device according to the invention. Although the new musical notation as well as the new keyboard according to the present invention greatly simplify the playing of fretted musical instruments, playing in the first fret position is still the easiest since a number of tones, depending on the number of strings, are already preset by the first fret. Thus, in some compositions, when played in the first fret position, i.e., without capo tasto, about fifty percent of the tones need not be fingered. However, for other compositions, fingering is simplified by using a capo tasto to select another first fret position. Therefore, when using the justifying device 10, it is considered advantageous to also use a presetting device similar to a capo tasto.

As shown, the preferred presetter according to the invention includes an arm 36 having mutually perpendicular legs 37 and 38, the leg 37 comprising the presetting bar. As shown, the arm 36 is pivotably mounted by adjusting screw 39 to a bar 42 adapted for a frictional sliding fit in the tapered groove 20 provided in one side of the lower part 18 of the block 2 (FIG. 1). The arm 36 is biased toward the bar 42 by suitable means, such as the coil spring 41 disposed about screw 39 between arm 36 and bar 42. Referring to FIG. 5, during presetting the arm 36 is held against its bias such that leg 38 is clear of the keys 16. The bar 42 is then moved in the groove 20 to the desired transverse row of keys 16 and the arm 36 released, whereupon leg 37 depresses the keys.

FIG. 5 also illustrates the justification of the twenty-one most popular fretted positions on a medium size fretted musical instrument. In accordance with the invention, the keys 16 are symmetrically arranged while the tongues 10 are asymmetrically arranged corresponding to the frets of a conventional fingerboard.

The justification device of the present invention may be built into newly manufactured instruments, as is illustrated in the accompanying drawings, or built separately and subsequently attached to the fingerboard of a conventional fretted instrument. If separately formed it may be secured to the instrument by any suitable means such as clamps, etc. Since the construction of such means is considered obvious to those skilled in the art, a futher description thereof is deemed unnecessary. Additionally, in accordance with the above-mentioned publication entitled "Musical Inspiration" the keys 16 may appear in twelve different colors, i.e. each tone of a complete tonality having its own distinctive color, thus facilitating play in any desired position or tonality.

FIG. 6 illustrates a fretted musical instrument together with the attached justification device 1 according to the invention. It will be apparent that instruments incorporating the invention may be made in different sizes, e.g. a small size having only five strings, a medium size having six strings and a concert size having seven strings embracing the complete diapason of the human voice.

Since these as well as other modifications and changes are intended to be within the scope of the present invention, the above description should be construed as illustrative and not in the limiting sense, the scope of the invention being defined by the following claims.

What is claimed is:

1. A justifying device mountable on the fingerboard of a stringed instrument having a plurality of frets, said device comprising:

a housing having an upper part and a lower part;

a plurality of keys mounted in the upper part of said housing for vertical movement therein, each key being movable between an initial position and a depressed position, said keys being arranged in transverse and longitudinal symmetry, each transverse row of keys corresponding to a given fret;

a plurality of tongues mounted for vertical movement in the lower part of said housing, there being one tongue for each key, said tongues being arranged in longitudinal asymmetry for alignment with said plurality of frets;

means for connecting each of said tongues to its corresponding key for vertical movement therewith, whereby when a key is in its depressed position its corresponding tongue presses the confronting string towards the fingerboard;

means for biasing said keys to their initial positions; and presetting means movably mounted on said housing for selectively depressing a transverse row of keys.

2. The justifying device according to claim 1, wherein said housing is provided with a longitudinally extending groove in one side thereof; and wherein said presetting means comprises a first arm dimensioned for a frictional sliding fit in said groove; a second arm pivotally secured at one end to said first arm, said second arm having a portion extending over said keys and of sufficient length to overlie a complete transverse row thereof; and means for biasing said second arm portion toward said keys.

3. The justifying device according to claim 1, wherein said housing has a plurality of channels, one between each key and its corresponding tongue, wherein said connecting means comprises a plurality of cables, one disposed in each channel, each cable being operatively connected at one end to its corresponding key and at its other end to its corresponding tongue; and wherein said biasing means comprises a plurality of springs, one spring for each key, each spring being seated in said housing for urging its corresponding key upward from said depressed position.

* * * * *